United States Patent [19]

Nwoko

[11] Patent Number: 4,970,763

[45] Date of Patent: Nov. 20, 1990

[54] HOOK-TYPE SPEED FASTENING DEVICE WITH OPTIONAL INTEGRATED, ADJUSTABLE WIDTH, ADJUSTABLE TENSION, EYELET CAPACITY

[76] Inventor: Luck Nwoko, 1629 Columbia Rd. NW. #110, Washington, D.C. 20009

[21] Appl. No.: 393,146

[22] Filed: Aug. 10, 1989

[51] Int. Cl.[5] ..... A43C 3/00

[52] U.S. Cl. ..... 24/714.4; 24/714.5

[58] Field of Search ..... 24/714.4, 714.5, 714.6, 24/714.3, 712, 713.9

[56] References Cited

U.S. PATENT DOCUMENTS

| | | | |
|---|---|---|---|
| 621,734 | 3/1899 | Adamson | 24/714.3 |
| 695,012 | 3/1902 | Telfer | 24/714.4 |
| 769,329 | 9/1904 | Streed | 24/714.5 |
| 783,949 | 2/1905 | Harden | 24/714.4 |
| 1,269,076 | 6/1918 | Hall | 24/714.5 |
| 1,413,629 | 4/1922 | Sutherland | 24/714.4 |
| 1,566,001 | 12/1925 | Herrick | 24/714.4 |
| 4,553,342 | 11/1985 | Derderian et al. | 24/712 |

*Primary Examiner*—Victor N. Sakran

[57] ABSTRACT

An improved hook-type speed fastening device with an optional, integrated, adjustable width, adjustable tension capacity is disclosed. In the main, the fastening device includes an inner eyelet-bearing head with a novel communicating outer loop, and a lace receiving slot. In an additional embodiment, a substantial linear format with serialized eyelets is disclosed.

3 Claims, 7 Drawing Sheets

HOOK-TYPE SPEED FASTENING DEVICE WITH OPTIONAL INTEGRATED, ADJUSTABLE WIDTH, ADJUSTABLE TENSION, EYELET CAPACITY

TECHNICAL FIELD

This invention relates in general to fastening systems, and more particularly to speed fastening systems, and the application of a novel and improved mode of lace reception and to an optional, integrated, adjustable width, adjustable tension eyelet capacity.

BACKGROUND OF THE INVENTION

Speed fastening devices are well known in athletic and outdoor activity shoes. The most prevalent and somewhat archaic form of speed fastening device being the projecting hook types which are securely mounted in a conventional manner in the upper portion of a footwear. However, in spite of the alacrity provided by the conventional hook-like fastening elements, there is an obvious drawback to this form. The shoelace is secured or anchored in only one direction; that is, inward towards the periphery of the shoe throat and once untied, will invariably slip out of the hook containment leading to an instant unravelling of the fastening pattern. A situation which I daresay generates its share of consternation and exasperation with many a shoewearer.

It is, therefore, desirable to design an essentially hook-type speed fastening device which, while providing a novel and enhanced threading capacity, also provides a containment configuration which secures the shoelace and allows for individual, shoe wearer induced disengagement of the shoelace. The system should also allow a shoelace to be threaded in and out of the fastening device with equal facility.

Furthermore, because extant hook-type fasteners used in bags, luggages and the like require thumb and index finger manipulation in order to provide engagement and disengagement (capacity) with a receiving bar, the present invention obviates the need for such encumberance by providing a fastening device with self-seeking chute or opening and innate elasticity in its configuaration.

SUMMARY OF THE INVENTION

The present invention relates to a speed fastening device for shoes, bags, clothing and the like which provides a novel and improved mode of lace reception. The present invention is also directed to a lower placed groove which is configured to serve as an ancillary or corollary eyelet, thus imbuing the fastening device with width adjustment and enhanced fastening tension capacity. The width adjustment capacity and/or increased lacing pressure is achieved by slipping or snapping the slack shoelace out from the inner or main eyelet into the ancillary eyelet. This corollary eyelet is formed by a recess or groove which lies within the protuberance or enlargement at the lower portion of the upwardly extending side member or bar.

The ancillary loop forms a bifurcated but communicating loop with the outer lace-introducing loop. The width and lacing pressure adjustment can be achieved without having to unthread the lace or loose the lacing pattern.

In preferred embodiment, the shoe with the present invention includes a left and right quarter and two types of eyelets, the eyelet-bearing device of the present invention and conventional eyelets aligned along the periphery of said quarters. A plurality of pairs of the eyelet-bearing fastening device are disposed along the periphery of said quarters, interposed between pairs of conventional eyelets. In a preferred embodiment, the eyelet-bearing fastening device is composed of a main body or head in which the main or inner eyelet, outer lace-introducing groove and stated optional ancillary eyelet are formed, and an integrally connected rigid posterior base or neck which, in turn, tapers downwardly. All made of one-piece plastic or metal.

The formation of the inner loop is a result of the looping of the upwardly extended side member or bar. This bar curves or bends at the top to form a downward extended bar which is in a direction parallel to the axis of the base. Towards its free end, the downward extended bar curves slightly inward to an outer edge or point. The outer edge of the downward bar does not reach the bottom of the outer loop or groove formed atop the base, thereby leaving a space large enough for the insertion of a shoelace.

The inner edge of the downward bar forms an enlargement, the highest point of which rests against the inside of the eyelet near the lower end, and, by its elasticity prevents the shoelace from passing in either direction without pressure being used. From this high point, the bar is beveled in each direction.

The fastening device is threaded by passing the shoelace down the outside of the downward bar till it falls into the space or slot between the tapered free end and the shoulder formed by the outer loop. Once within the outer loop, the shoelace is then drawn upward into the inner eyer, the elasticity of the downward bar permitting the shoelace to pass. The integrated inner eyelet and outer loop, and the ancillary eyelet in the alternate form all present openings large enough for the easy passage of a shoelace.

The bevel on the inside of the inner eye or loop permits the shoelace to be withdrawn with equal facility, the object of this being to unfasten the shoelace without having to pull the end of the lace through the eye; and most significantly, the restraining effect of the beveled contact point prevents the shoe's lacing pattern from unravelling.

In a preferred embodiment, the reduced, tapered lower extremity is inserted into a slit and stitched to the upper along the throat. The visible portion of the lacing device, the head, faces inward toward the periphery of the said throat.

Formed of one-piece thermo-plastic or metal material, about $\frac{3}{8}$"W×3/16"D×$\frac{7}{8}$"H (larger dimensions will be required for items such as luggage or bag straps, belts, etc.), the body of the present invention is preferably of a solid rectangular or oval cross-section while the lower portion is of a substantially tapered or constricted cross-section. Exact dimensions will be determined by those skilled in the art.

An athletic shoe with an improved fastening system of the kind herinabove described can be quickly and easily laced. Furthermore, unlike conventional speed fastening systems, the present invention provides, in an alternate form, an integrated ancillary eyelet, and based on the perpendicular alignment of the lacing device to the axis of the shoe throat, the ancillary eyelet provides adjustment capacity along selected areas of the instep of the shoe.

The invention consists of several novel features which are hereinafter set forth and are more particularly defined by claims at the conclusion hereof.

For a better understanding of the invention and the advantages thereof, reference should be made to the following descriptive matter taken in conjunction with the accompanying drawings.

DETAILED DESCRIPTION OF THE INVENTION

Figure 1:
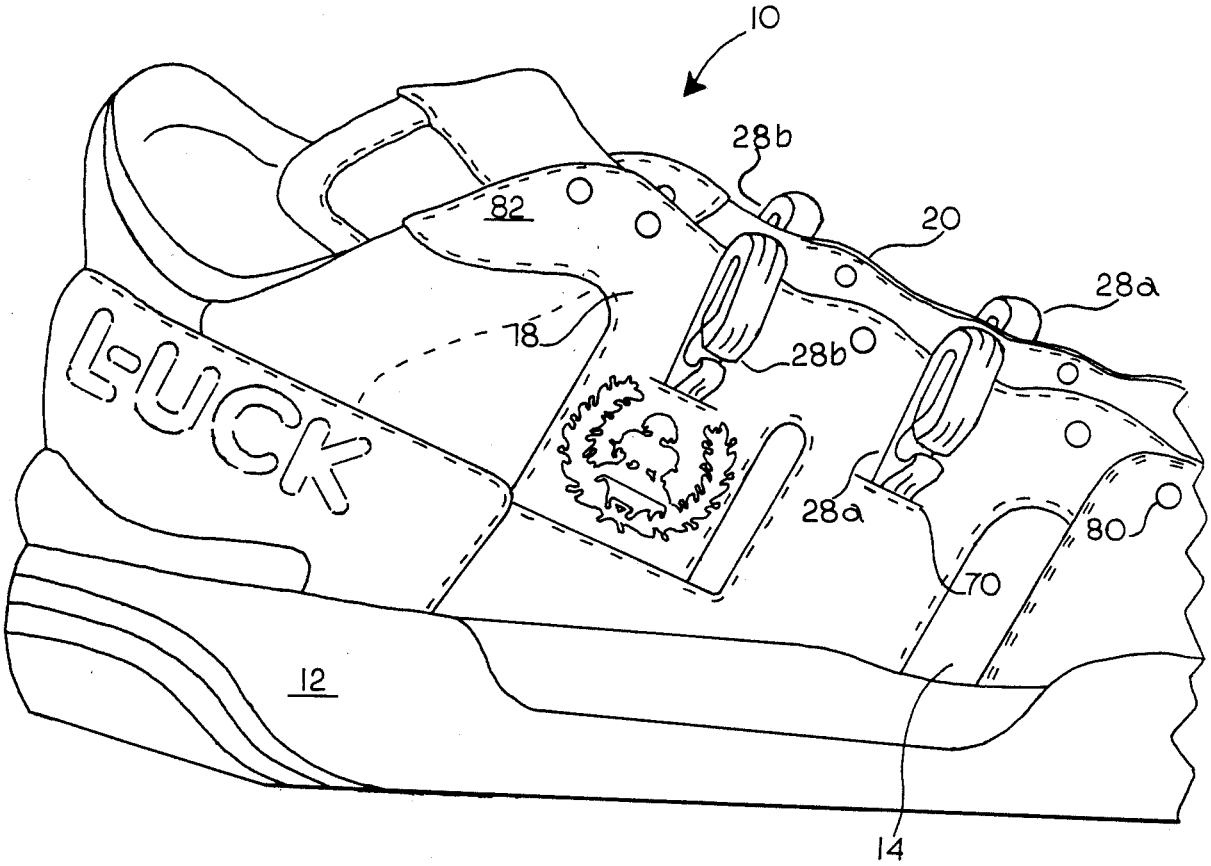
FIG. 1 is a perspective view, heel and metatarsal areas, of an athletic shoe embodying the invention.

Referring to the drawings, and more particularly to FIG. 1, there is shown an athletic shoe 10 in accordance with the present invention. Shoe 10 has a sole 12 to which is attached an upper 14. Upper 14 has a right quarter 18 and a left quarter 20. A shoe lace is meant to fasten left quarter 20 to right quarter 18.

Figure 2:
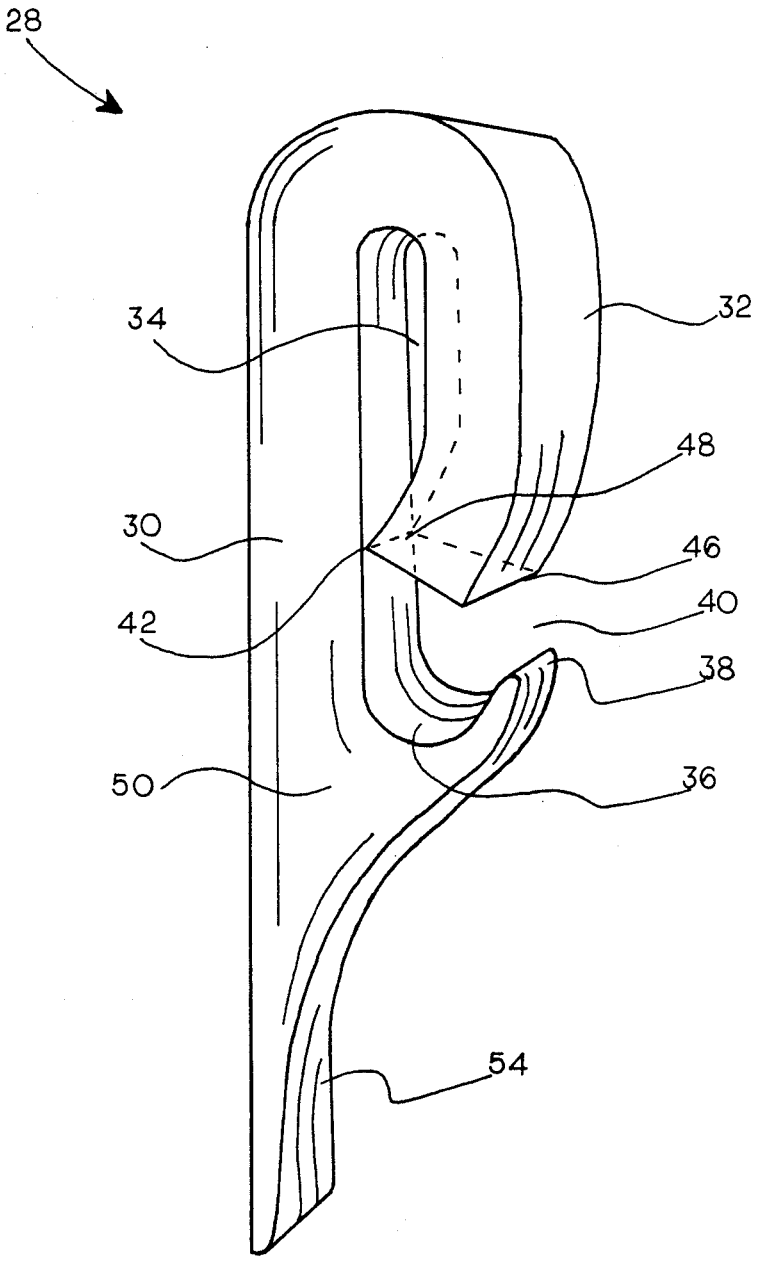
FIG. 2 is an enlarged, oblique, side view of a fastening device according to the invention.

An enhanced hook-type fastening device 28 is shown in FIG. 2 with a lace introducing outer loop and lace receiving or anchoring inner loop or eyelet. Fastening device 28, with inner eyelet 34 and outer, lace introducing loop 36 is inserted, in substantially aligned, alternating pairs, **28*a*–28*b*, into slits 70 and stitched to reinforcing member 82 and upper 14. Fastening device 28** should preferably be constructed of one-piece, rigid but pliant plastic or metal material.

The two aligned pairs of fastening device 28, alternately placed, in the metatarsal area, are arranged along opposing quarters 18 and 20. Inner eyelet 34 with lace introducing outer loop 36, slot 40, side members 30 and 32 all face inward toward the shoe opening. The two integrated loops, 34 and 36, are formed by the looping and grooving of side member 30 and neck member 50 respectively. Side member 30 arises integrally from neck 50.

As shown in FIG. 2, the upwardly extended side member 30 curves or loops at the top to form a downward extended side member or bar 32. The containment capacity of loop 34 is defined by the truncated yet contacting—at an inner point—configuration of bar 32, all in a direction parallel to the axis of the base. Toward its free end, 46, side member 32 curves slightly inward but does not reach the bottom of outer loop 36 or shoulder 38, thus creating a space or slot, 40, large enough to insert a lace.

Side member 32 has an enlargement 48 at its end, the highest point resting against the inside of the inner eyelet 34 near the lower end, and, by it elasticity, preventing the lace from passing the restrictive entrant passage at 42 in either direction without some pressure being applied.

From the highest point of enlargement 48 side member 32 is beveled in each direction, terminating at the edge or free end 46 on one side, and in the straight part of bar 32 of the loop 34, on the other side. Thus forming an essentially wedge-shaped configuration.

Fastening device 28 is threaded by passing a lace down the outside of member 32 till it passes through slot 40 and into outer loop 36. Said lace is then drawn upward and the bevel from free edge 46 to point 42 directs the lace into inner eyelet 34, the elasticity of the finger or side member 32 permitting it to pass.

The bevel on the inside of inner loop 34 permits said lace to be withdrawn with equal facility, the object of this being to unfasten the lace without having to pull the end of the lace through the eye. Furthermore, the yielding yet restraining entrant passage point 42 allows for the said lace to be disengaged from lacing device 28 individually and with as much rapidity as required without leading to the total unravelling of the lacing pattern.

It must be noted that, outer loop 36 and inner eyelet 34 are configured wide or large so as to loosely receive an incoming lace. The inherent tensility of suggested materials for fastening device 28, such as plastic, metal, horn, bone etc., provides the system with its elasticity or lateral flexion capacity.

FIG. 1 shows shoe 10 with a combination of conventional eyelets 80, aligned in staggered pairing, and interposing pairs of the new fastening device. Holes 80 are formed through upper 14 and reinforcing member 82 along the periphery of the shoe opening.

FIG. 2 presents fastening device 28 in detail. The downward extended, tapered, member 54 is an integral extension of neck member 50. Member 54 is inserted into slit 70 for attachment to the shoe upper.

Figure 3:
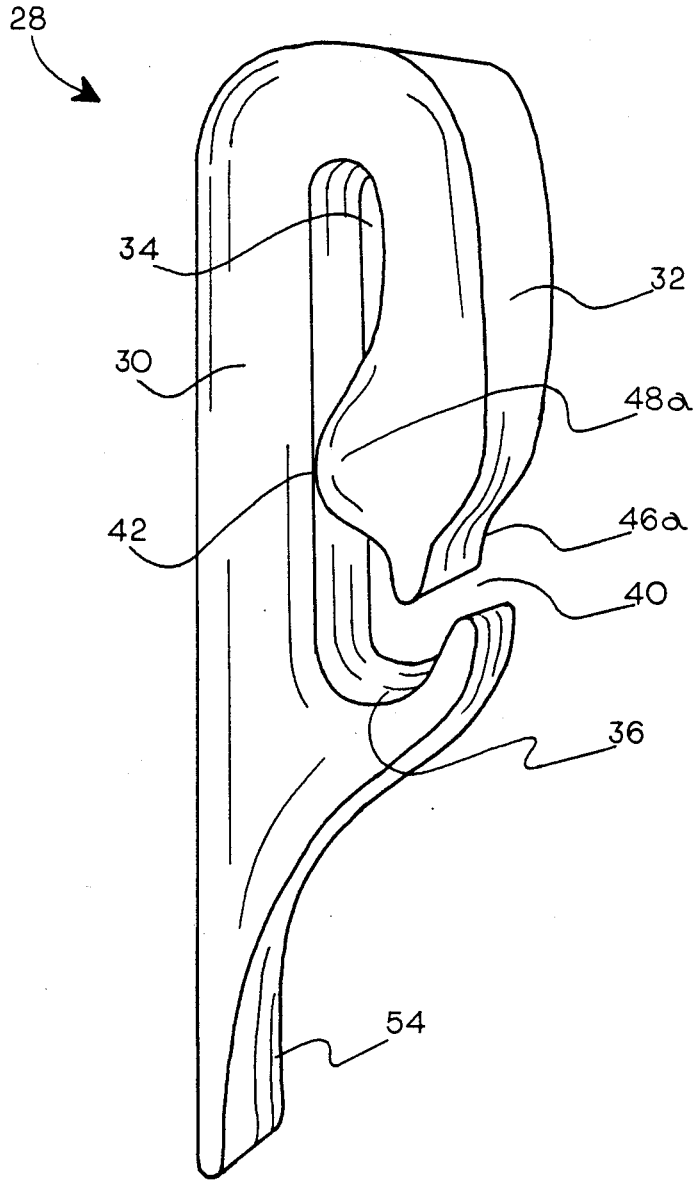
FIG. 3 is an enlarged, oblique, side view of a fastening device embodying another form of the invention.

In another embodiment, FIG. 3, it will be noted that in place of the essentially wedge-shaped configuration of enlargement 48, there is an essentially rounded, convex enlargement **48*a*. Beyond enlargement 48*a*, bar 32 is reduced and tapered, as shown at 46*a*. The side of major projection of enlargement 48*a* resting normally against side member 30 between loops 34 and 36 and with the reduced end portion 46*a* lying between and spaced (slot 40) from shoulder 38. It will be noted that the curves of enlargement 48*a* form continuous compound curves at the adjacent portions of member 30, so that the lace may be easily passed into eye 34 when proper pressure is applied thereto. Also when the lace is to be disengaged from eye 34 it may be passed in an opposite direction from the last described and will force enlargement 48*a* at restrictive entrance 42 out of contact with the straight portion of bar 30, so that the lace will pass into outer loop 36 and out through slot 40**.

Figure 4:
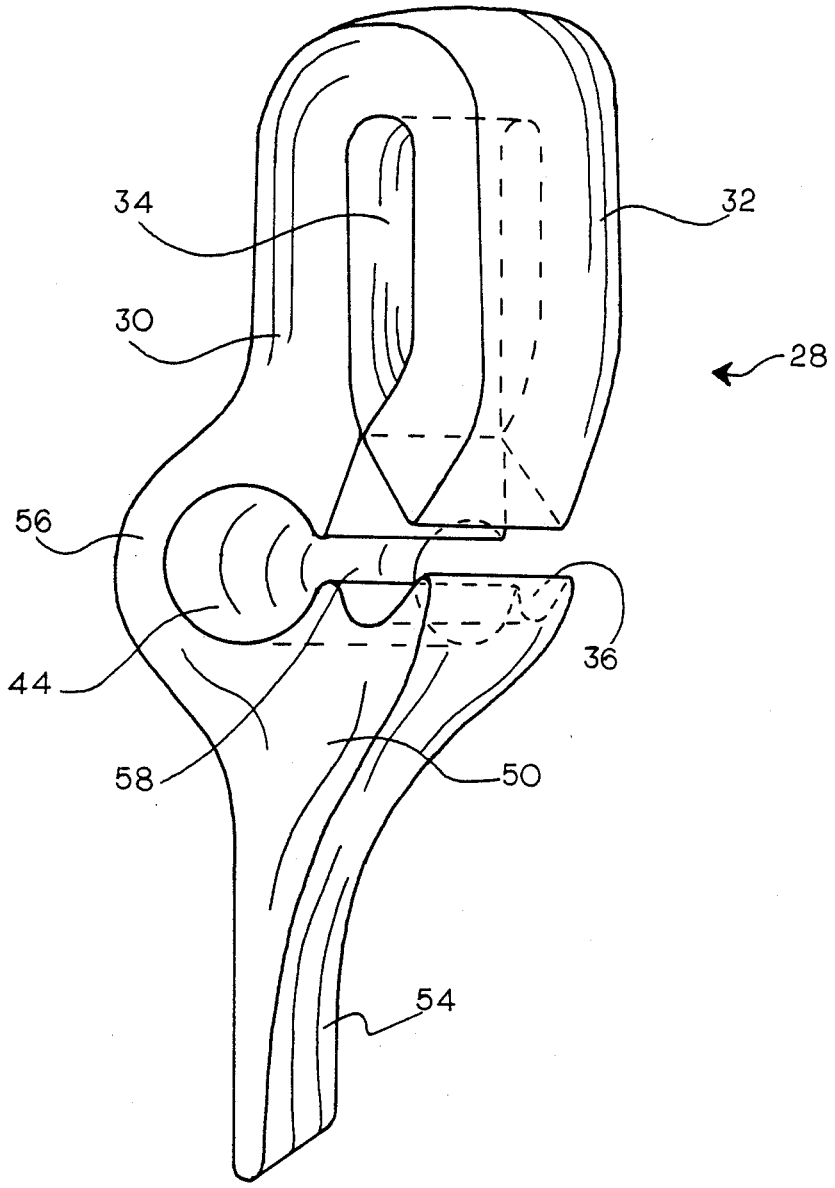
FIGS. 4 and 5 are enlarged, oblique, side views of FIGS. 2 and 3 respectively. This format provides width adjustment capacity.
Figure 5:
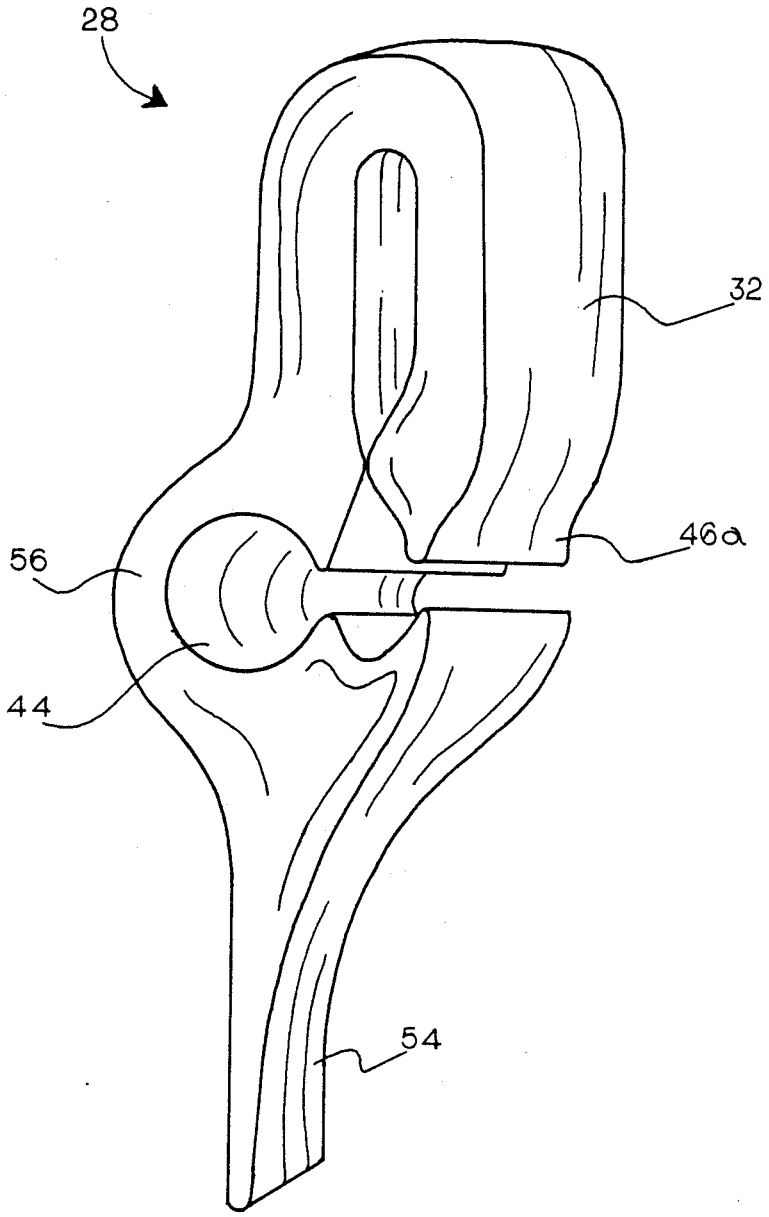

Although the invention has been described with reference to a particular embodiment, other configurations can be made without departing from or sacrificing any of the advantages of the invention. In an alternate form (FIGS. 4/5) it will be seen that side member 30 is invested at its lower portion just above neck 50 with a protuberance or enlargement 56 which contains ancillary groove or eyelet 44 which opens into outer loop 36 through slot 58, like slot 40, loops 36 and 34, ancillary eyelet 44 and its communicating slot 58 are large enough to allow easy passage and containment of a lace.

The essentially parallel but lower alignment and integration of ancillary eyelet 44 provides this alternate form of fastening device 28 with a width adjustment, tension adjustment capacity. The alternate form, like the original, should preferably be made of one-piece plastic, or metal material.

Furthermore, by interposing, sequentially, the modified fastening device 28—with its enhanced lacing pressure capacity—with a plurality of conventional eyelets in a shoe, the wearer is provided with a multiplicity of lacing pressure configurations along the metatarsal zone. This enhanced capacity for metatarsal area adjustment is most crucial to shoe wearers with high or low insteps.

Figure 6:
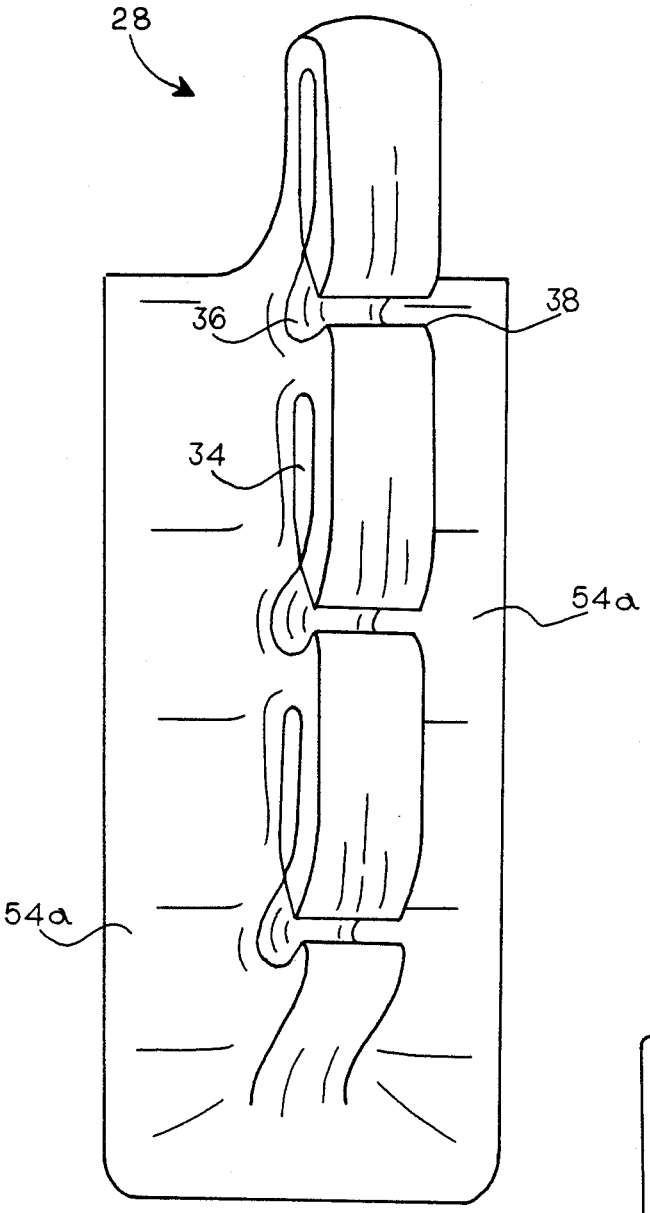
FIGS. 6/7 and 8/9 are enlarged, oblique, frontal views of a substantially linear form, with serialized eyelets, of FIGS. 2/4 and 3/5 respectively.
Figure 7:
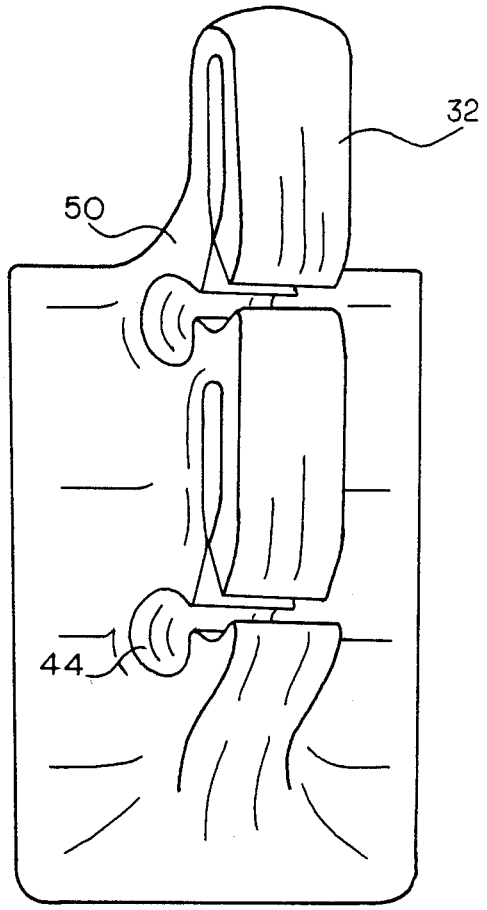
Figure 8:
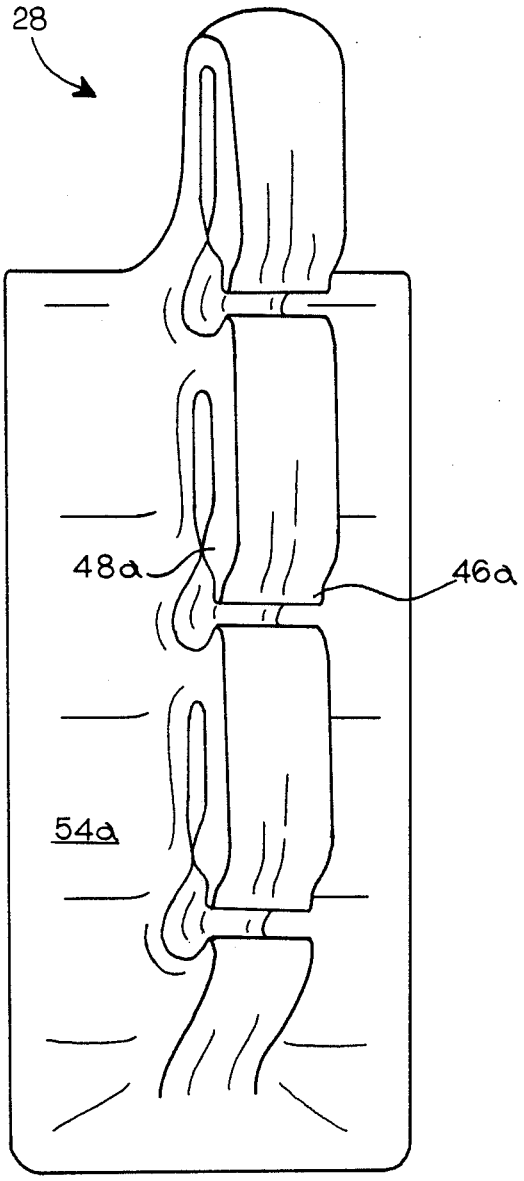
Figure 9:
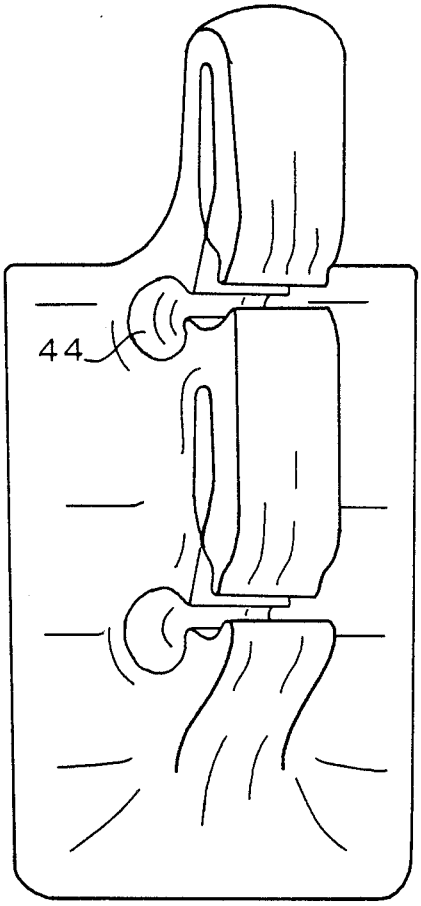

In another embodiment, FIGS. 6/7 and 8/9, fastening device 28 is provided with a plurality of (main) eyelets (34) with or without ancillary eyelet (44) in a downward tending, substantially linear arrangement made of one-piece construction; thus imbuing lacing device 28 with a mega capacity for lacing configurations and tension enhancement. It will be noted that this essentially linear, serialized eyelet form is further provided with a tapered, outwardly extended flange member 54*a*—integrally, outwardly extended from about the neck portion of both sides of bar member 30, and joined at the bottom of the new format in a U-shaped continuum. Said tapered flange member 54*a* is for insertion into a conforming recession or slit along the periphery of the aperture of a shoe, belt and the like, after which it is then stitched.

When recognition is given to the arcuate or bevelled nature of the instep and the substantialy linear form of the serialized format, the question of conformity comes to fore. With the somewhat greater elastic modality of plastic, the serialized format should substantially conform to the arcuate form of the instep when structured in plastic. The tensility or tautness of metals requires a modulation of the linear profile of 54*a*—to wit an arcuate profile is envisioned.

An improved fastening system of the kind herinabove described can be quickly and easily threaded by the use of novel, lace-directing grooves. Furthermore, in its alternate form, the fastening device is provided with an integrated ancillary groove, thus imbuing the system with a width and tension adjustment capacity.

While particular embodiments of the present invention have been disclosed, it is to be understood that various changes may be made in the embodiment of the invention herein specifically described, without, departing from the true spirit and scope of the appended claims, and nothing herein shall be construed as limitations upon the invention, its concept or structural embodiment as to the whole or any part thereof. Furthermore, in addition to articles of footwear, the present invention can be used as a fastening element for clothing and other items such as belts, luggages, handbags, etc.

What is claimed is:

1. A fastening device for attachment along the periphery of the throat or aperture of an article of footwear, clothing, luggages and the like to uniquely receive and provide guidance to laces of a lacing system, comprising:

an eyelet bearing fastening device (28), preferably constructed of one-piece, rigid but pliant material, and adapted to be attached along the periphery of the aperture of an article of footwear, clothing, luggages and the like to uniquely receive and provide guidance to laces of a lacing system, said fastening device provided with an upwardly extended side member (30) which loops at the top to form a downward extended member (32), the loop of said upward member resulting in the formation of the inner eyelet (34), said inner eyelet being wide spaced so as to loosely receive a lace, said downward extended member being slightly curved inward toward a free end (46) but not reaching the bottom of the outer loop (36) or the shoulder (38) thus creating a space or slot (40), said outer loop and slot being large enough for the easy introduction of a lace, said downward extended member having an enlargement (48) at its free end, the highest point resting against the inside of said inner eyelet near the lower end, thereby forming the restrictive passage (42), and, by its elasticity, preventing said lace from passing in either direction without some pressure being applied, said enlargement of said downward extended member being beveled, from its highest point, in each direction, said bevelling terminating at the free end (46) on one side, and in the straight part of the side member (32) of said inner eyelet, thereby forming an essentially wedge-shaped configuration, said fastening device being threaded by passing a lace down the outside of the downward member (32) till said lace passes through the slot (40) into said outer loop, from whence said lace is drawn upward and said beveling from said free end to said restrictive passage point directs said lace into said inner eyelet, the elasticity of said downward member permitting it to pass, said beveling on the inside of said inner eyelet allows said lace to be withdrawn with equal facility, said upward extended member (30) arises integrally from a rigid neck member (50) which also forms the lace introducing outer loop (36) and the upward tending shoulder (38), said neck member forms an integral, downward extended, tapered lower extremity (54), said tapered member being rigid, and said side member (30) provides at its lower portion, just above the neck (50), a protuberance or enlargement (56) which contains the ancillary groove or eyelet (44), said ancillary eyelet communicating with the outer loop (36) through a slot (58), and said ancillary eyelet and slot being wide spaced for easy lace reception.

2. A fastening device of claim 1 wherein said ancillary eyelet is essentially parallel to but lower than the inner eyelet (34), thus providing the lacing device with an adjustable width, adjustable tension capacity.

3. A fastening device of claims 2 wherein said fastening device is provided with a plurality of (main) eyelets (34), with or without said ancillary eyelet, in a substantially linear arrangement, said fastening device with a plurality of descending eyelets being further provided with the tapered, outwardly extended flange member (54*a*).

* * * * *